US009016904B2

(12) United States Patent
Lee

(10) Patent No.: US 9,016,904 B2
(45) Date of Patent: Apr. 28, 2015

(54) LED LAMP

(71) Applicants: Hsiang-Yu Lee, Taipei (TW); Chia-Yu Lee, Taipei (TW)

(72) Inventor: Chia-Yu Lee, Taipei (TW)

(73) Assignees: Hsiang-Yu Lee, Taipei (TW); Chia-Yu Lee, Taipei (TW)

( * ) Notice: Subject to any disclaimer, the term of this patent is extended or adjusted under 35 U.S.C. 154(b) by 146 days.

(21) Appl. No.: 13/777,740

(22) Filed: Feb. 26, 2013

(65) Prior Publication Data

US 2014/0153259 A1 Jun. 5, 2014

(30) Foreign Application Priority Data

Dec. 4, 2012 (TW) ..... 101223482 U

(51) Int. Cl.

| | |
|---|---|
| ***F21V 29/00*** | (2006.01) |
| ***F21V 3/00*** | (2006.01) |
| ***F21K 99/00*** | (2010.01) |
| ***F21V 23/00*** | (2006.01) |

(52) U.S. Cl.

CPC ..... *F21K 9/135* (2013.01); *F21V 29/2231* (2013.01); *F21V 23/009* (2013.01)

(58) Field of Classification Search

None

See application file for complete search history.

(56) References Cited

U.S. PATENT DOCUMENTS

2006/0227558 A1* 10/2006 Osawa et al. ..... 362/351
2008/0157112 A1* 7/2008 He et al. ..... 257/98

* cited by examiner

*Primary Examiner* — Britt D Hanley

(74) *Attorney, Agent, or Firm* — Muncy, Geissler, Olds & Lowe, P.C.

(57) ABSTRACT

A LED lamp includes a lamp base unit including an insulative base, a mating connection device configured like the base of a conventional incandescent bulb and located at the bottom side of the insulative base, an insulative hollow column located at the top side of the insulative, a heat sink including a plurality of radiation fins radially arranged around the insulative hollow column, a light-emitting module including a heat transfer plate fastened to the heat sink at the top, a circuit board supported on the heat transfer plate and light-emitting devices installed in the circuit board, and a light transmissive lampshade fastened to the heat sink and covered over the light-emitting module.

5 Claims, 4 Drawing Sheets

LED LAMP

This application claims the priority benefit of Taiwan patent application number 101223482, filed on Dec. 4, 2012.

BACKGROUND OF THE INVENTION

1. Field of the Invention

The present invention relates to lighting technology and more particularly, to a LED lamp, which comprises a lamp base unit, a heat sink comprising a plurality of radiation fins radially arranged around an electrically insulative hollow column of the lamp base unit, a light-emitting module supported on the heat sink, and a light transmission lampshade fastened to the heat sink and covered over the light-emitting module.

2. Description of the Related Art

Regular fluorescent tubes commonly use electricity to excite mercury vapor, causing excited mercury atoms to produce short-wave ultraviolet light that then causes a phosphor to fluoresce, producing visible light in a particular color temperature subject to the nature of the phosphor applied. However, fluorescent tubes have the disadvantages of fast attenuation of light, high consumption of power, high initial cost, being subject to flickering and short lifespan. In response to demands for environmental protection and energy saving, LED-based lighting fixtures are created. Nowadays, LED bulbs are intensively used in embedded light, head light, desk lamp and other lighting fixtures to substitute for conventional fluorescent tubes for the advantages of energy-saving, constant wavelength, light volume and quality adjustability, compact size, low heat generation and long lifespan.

A conventional LED lamp is known comprising a lamp holder, a plurality of radiation fins, and a light-emitting module. The lamp holder comprises an insulative base, a socket mounted at the insulative base, and a power drive module accommodated in the insulative base. The radiation fins are arranged around the socket. The light-emitting module comprises a circuit board mounted at the top side of the radiation fins and electrically connected to the power drive module in the insulative base by electric wires, and light-emitting devices, for example, LED chips installed in the circuit board. When electrically conducted, the LED chips are driven by the power drive module to emit light through a lampshade that surrounds the light-emitting module. At this time, waste heat generated by the LED chips is transferred by the circuit board to the radiation fins for quick dissipation. According to this design, the insulative base and the socket are independent members that are separately made by using different molds. This design complicates the fabrication of the lamp holder, lowering the yield rate and increasing the manufacturing cost. An improvement in this regard is necessary.

SUMMARY OF THE INVENTION

The present invention has been accomplished under the circumstances in view. It is therefore the main object of the present invention to provide a LED lamp, which has a compact design, facilitating high yield rate mass production, reducing the manufacturing cost, enhancing quick dissipation of waste heat, improving luminous efficiency and reliability.

To achieve this and other objects of the present invention, a LED lamp comprises a lamp base unit, which comprises an electrically insulative base, a mating connection device configured like the base of a conventional incandescent bulb, an electrically insulative hollow column vertically upwardly extended from and formed integral with the electrically insulative base and accommodation chamber defined within the mating connection device and the electrically insulative hollow column, a heat sink, which comprises a plurality of radiation fins radially arranged together, a center insertion space surrounded by the radiation fins and coupled to the electrically insulative hollow column of the lamp base unit and a recessed locating portion located at the top side of the radiation fins, a light-emitting module, which comprises a heat transfer plate mounted at the recessed locating portion of the heat sink, a circuit board supported on the heat transfer plate and light-emitting devices, for example, LED chips installed in the circuit board. The integrated design of the electrically insulative base and the electrically insulative hollow column facilitates the fabrication of the lamp base unit.

Further, the heat transfer plate of the light-emitting module is kept in close contact between the circuit board and the radiation fins of the heat sink, waste heat generated during operation of the light-emitting devices can be quickly transferred to the radiation fins for quick dissipation.

The LED lamp further comprises a lampshade covering the circuit board over the LED chips, and preferably a lens covering said light-emitting devices within the lampshade for condensing emitted light. The lens is detachably fastened to the heat transfer plate of the heat sink. The detachable mounting arrangement between the lens and the heat transfer plate of the head sink allows quick mounting and dismounting of the lens. Thus, differently configured lenses can be prepared for selection. The use of the lens enhances the luminous efficiency and structural reliability.

DETAILED DESCRIPTION OF THE PREFERRED EMBODIMENT

Figure 1:
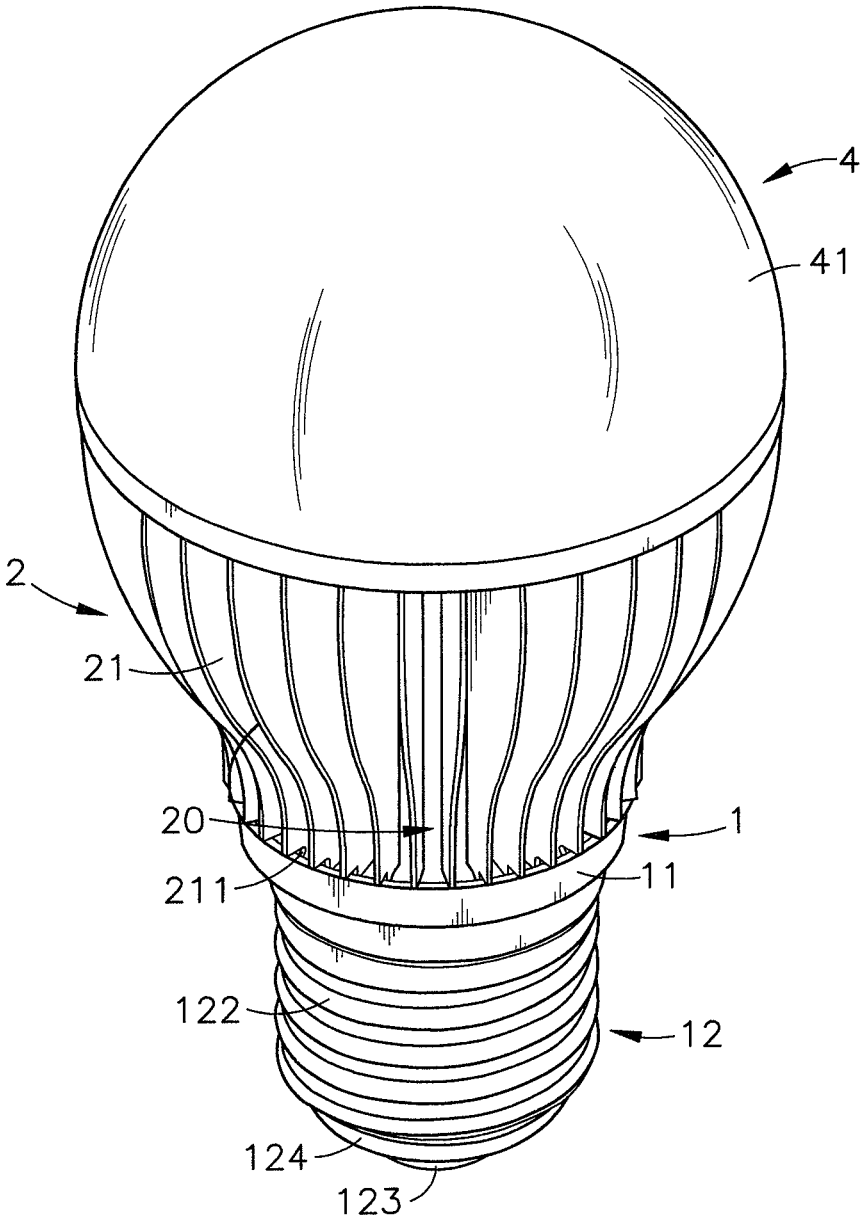
FIG. 1 is an elevational view of a LED lamp in accordance with the present invention.
Figure 2:
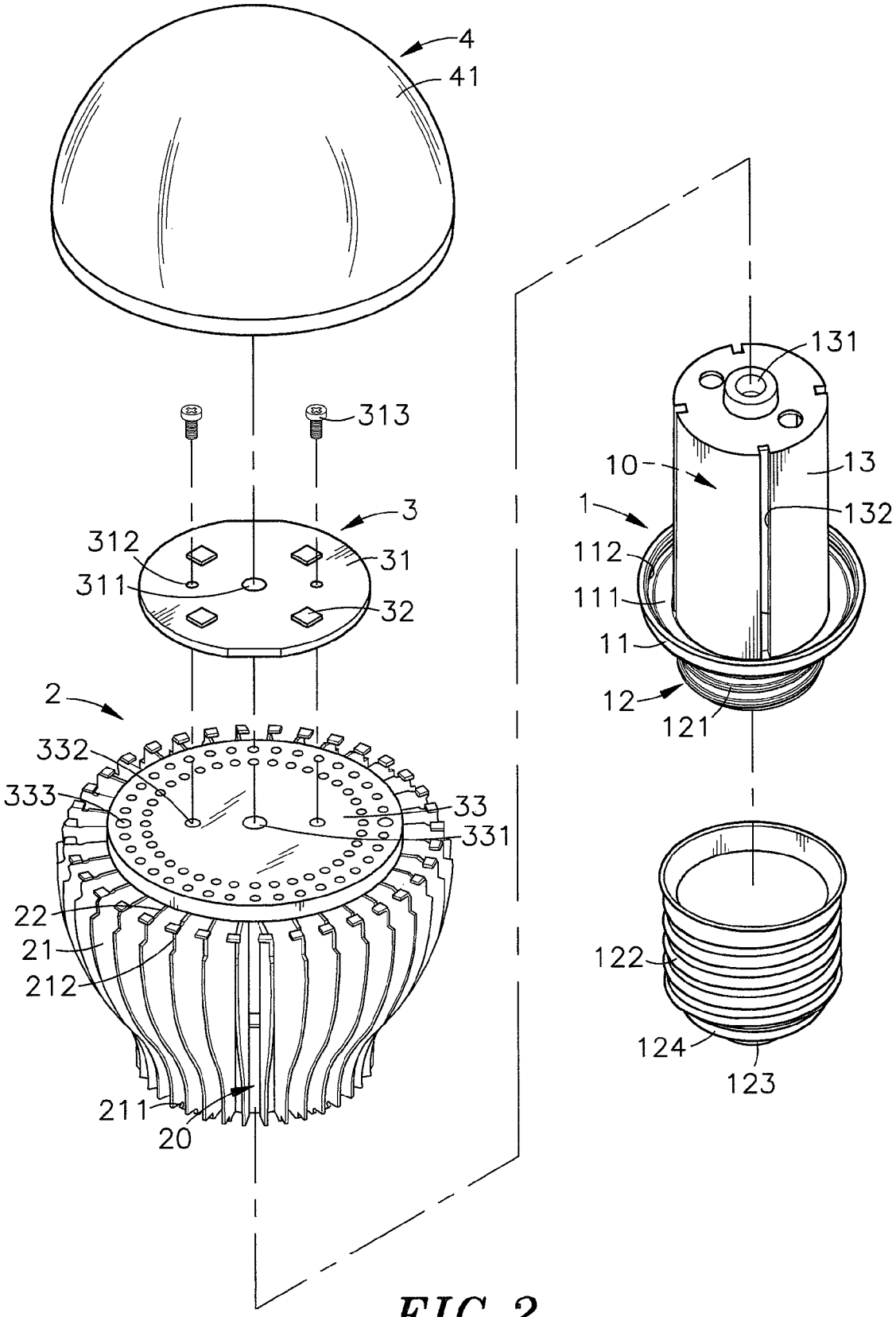
FIG. 2 is an exploded view of the LED lamp in accordance with the present invention.
Figure 3:
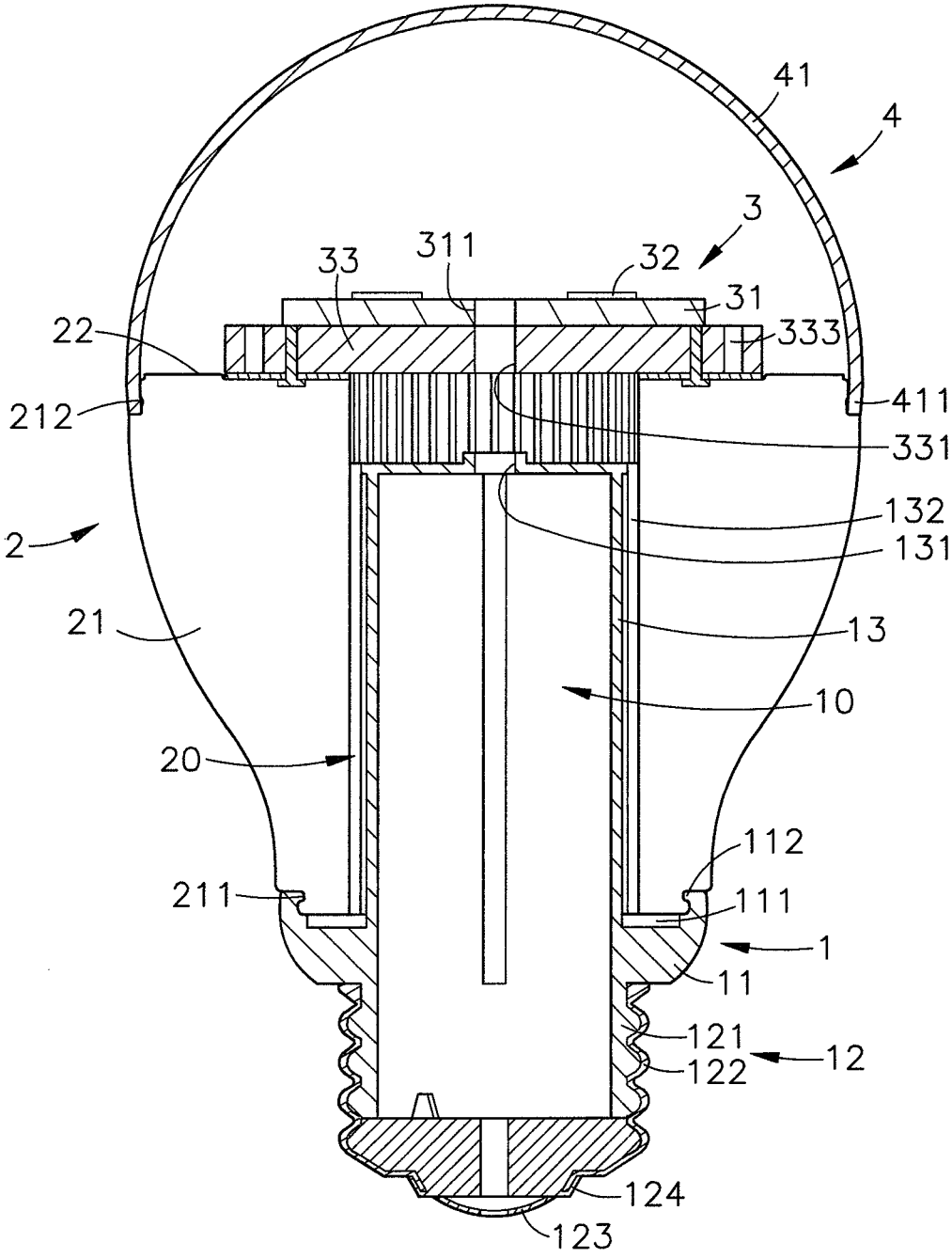
FIG. 3 is a sectional side view of the LED lamp in accordance with the present invention.

Referring to FIGS. 1-3, a LED lamp in accordance with the present invention is shown. The LED lamp comprises a lamp base unit 1, a heat sink 2, a light-emitting module 3, and a lampshade 4.

The lamp base unit 1 comprises an electrically insulative base 11, a mating connection device 12 configured like the base of a conventional incandescent bulb and comprising an externally threaded coupling neck 121 vertically downwardly extended from the electrically insulative base 11, a metal ring contact 122 surrounding the externally threaded coupling neck 121, a metal tip contact 123 disposed at the bottom side of the metal ring contact 122 and an insulative layer 124 isolating the metal tip contact 123 from the metal ring contact 122, an electrically insulative hollow column 13 vertically upwardly extended from the electrically insulative base 11 in axial alignment with the externally threaded coupling neck 121 of the mating connection device 12, an accommodation chamber 10 defined within the mating connection device 12 and the electrically insulative hollow column 13 and adapted to accommodate a power drive module (not shown), a through hole 131 located at the topmost edge of the electrically insulative hollow column 13 in communication with the accommodation chamber 10, a plurality of longitudinal grooves 132 spaced around the periphery of the electrically insulative hollow column 13, a mounting groove 111 defined within the electrically insulative base 11 around the electrically insulative hollow column 13, and at least one retaining portion 112 protruded from the electrically insulative base 11 and suspending in the mounting groove 111. The electrically insulative base 11 and the electrically insulative hollow column 13 are integrally made in one piece, reducing the number of fabrication tools needed for making the lamp base unit, facilitating high yield rate mass production and reducing the manufacturing cost.

The heat sink 2 comprises a plurality of radiation fins 21 radially arranged together, a center insertion space 20 surrounded by the radiation fins 21, and a recessed locating portion 22 located at the top side of the radiation fins 21 around the center insertion space 20. Each radiation fin 21 defines a first locating notch 211 at an outer bottom side thereof, and a second locating notch 212 at an outer top side thereof.

The light-emitting module 3 comprises a circuit board 31, a plurality of light-emitting devices 32 installed in the top side of the circuit board 31, and a heat transfer plate 33 made out of, for example, aluminum alloy and attached to the bottom side of the circuit board 31. The circuit board 31 comprises a center through hole 311, and a plurality of mounting through holes 312 spaced around the center through hole 311. The heat transfer plate 33 comprises a center through hole 331 and a plurality of mounting screw holes 332 respectively disposed corresponding to the center through hole 311 and mounting through holes 312 of the circuit board 31. Screws 313 are respectively mounted in the mounting through holes 312 of the circuit board 31 and threaded into the respective mounting screw holes 332 of the heat transfer plate 33 to affix the circuit board 31 and the heat transfer plate 33 together.

The circuit board 31 of the light-emitting module 3 can be made out of an aluminum substrate, copper substrate, ceramic substrate, copper-clad ceramic substrate, or any of a variety of other high conductivity circuit boards. The light-emitting devices 32 can be high power LED chips, low power LED chips, color LED chips installed in the circuit board 31 using SMT or through-hole technology.

The lampshade 4 is a semispherical member made out of a transparent or translucent material, comprising a light transmission body portion 41 and at least one retaining portion 411 located at an inner bottom side of the light transmission body portion 41.

During installation, insert the electrically insulative hollow column 13 of the lamp base unit 1 into the center insertion space 20 of the head sink 2 to accommodate the radiation fins 21 in the mounting groove 111 within the electrically insulative base 11 and to force the first locating notches 211 of the radiation fins 21 into engagement with the retaining portion 112 of the lamp base unit 1, and then press-fit the heat transfer plate 33 of the light-emitting module 3 into the recessed locating portion 22 of the heat sink 2 and directly rivet the radiation fins 21 to the heat transfer plate 33, and then cap the lampshade 4 on the heat sink 2 over the light-emitting module 3 to force the at least one retaining portion 411 of the lampshade 4 into engagement with the second locating notches 212 of the radiation fins 21.

Further, the aforesaid power drive module is electrically connected to the metal ring contact 122 and metal tip contact 123 of the lamp base unit 1 by respective electric wires (not shown) that are inserted through the through hole 131 of the electrically insulative hollow column 13 of the lamp base unit 1, the center through hole 331 of the heat transfer plate 33 and the center through hole 311 of the circuit board 31 and then respectively electrically connected to positive and negative power contacts of the circuit board 31. The power drive module is adapted to convert external AC power supply to DC power supply by means of rectifier and ballast (not shown) for the operation of the light-emitting module 3. The structural details and functioning of the power drive module are of the known art and not within the scope of the present invention, no further detailed description in this regard shall be necessary.

During application of the LED lamp, fasten the mating connection device 12 of the lamp base unit 1 to an external lamp socket (of an embedded light, head light or desk lamp) to force the metal ring contact 122 and metal tip contact 123 into contact with the positive and negative metal contacts of the lamp socket. When electrically conducted, the power drive module drives the light-emitting devices 32 to emit light through the light transmission body portion 41 of the lampshade 4 toward the outside for illumination. During operation, the heat transfer plate 33 transfers waste heat generated by the light-emitting devices 32 to the radiation fins 21 of the heat sink 2, enabling the radiation fins 21 to dissipate waste heat into the outside open air rapidly, avoiding accumulation of waste heat in the LED lamp and enhancing the performance of the LED lamp.

Figure 4:
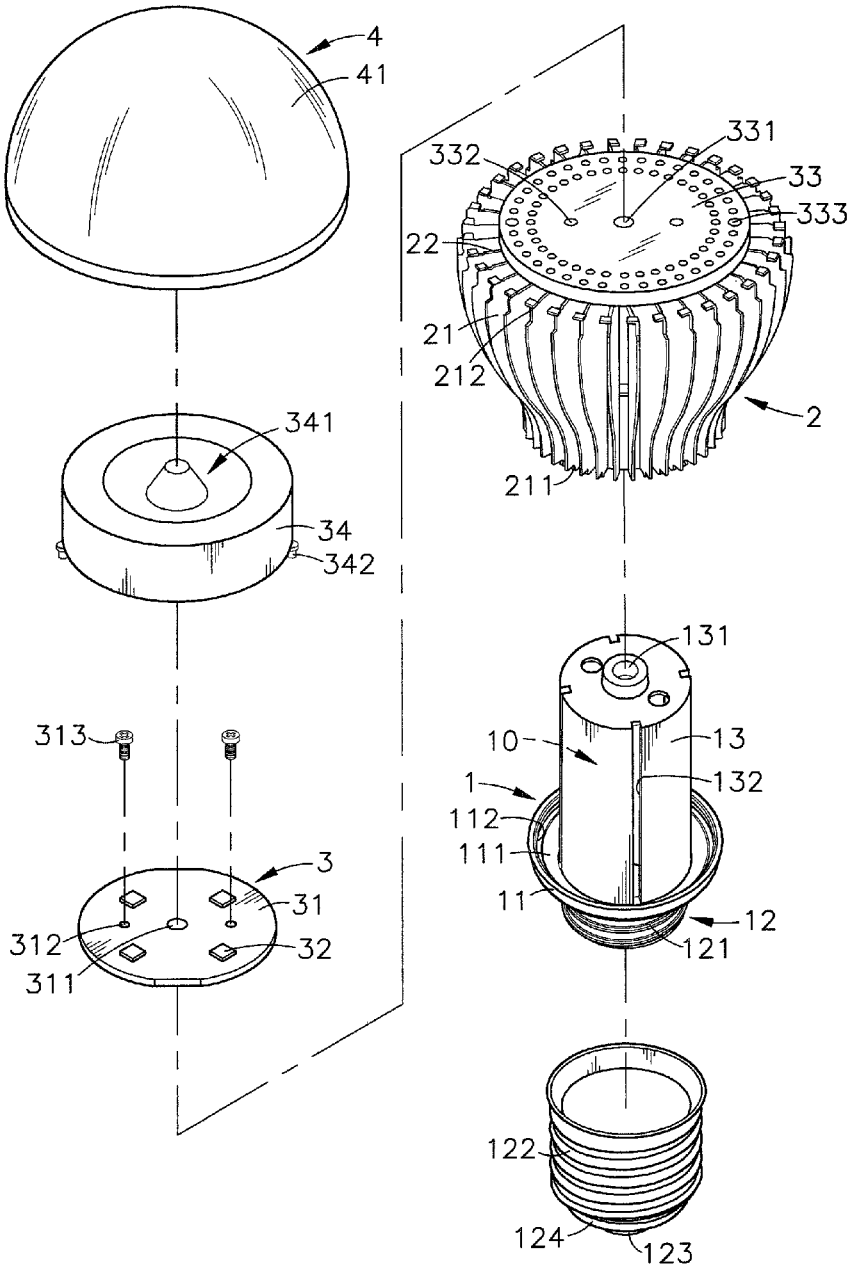
FIG. 4 is an exploded view of an alternate form of the LED lamp in accordance with the present invention.

FIG. 4 illustrates an alternate form of the LED lamp. According to this alternate form, the LED lamp further comprises a lens 34 covering the circuit board 31. The lens 34 comprises a plurality of mounting legs 342 respectively fastened to respective mounting holes 333 at the heat transfer plate 33 and a plurality of light-guide portions 341 located at the top side thereof at different elevations and surrounding one around another. During operation of the LED lamp, the light-guide portions 341 of the lens 34 of the light-emitting module 3 concentrate and guide emitted light from the light-emitting devices 32 toward the light transmission body portion 41 of the lampshade 4, providing enhanced illumination. Further, because the heat transfer plate 33 has its top side disposed above the elevation of the topmost edges of the radiation fins 21. Light rays emitted by the light-emitting devices 32 and passed through the lens 34 will not be hindered by the radiation fins 21, achieving omnidirectional illumination. Further, the mounting arrangement between the lens 34 and the heat transfer plate 33 allows quick mounting and dismounting of the lens 34. Thus, lenses 34 having differently configured light-guide portions 341 can be prepared for selection. The use of the lens 34 enhances the luminous efficiency and structural reliability.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A LED lamp, comprising:

a lamp base unit comprising an electrically insulative base, a mating connection device configured like the base of a conventional incandescent bulb and disposed at a bottom side of said electrically insulative base, an electrically insulative hollow column vertically upwardly extended from said electrically insulative base in axial alignment with said mating connection device, and accommodation chamber defined within said mating connection device and said electrically insulative hollow column;

a heat sink comprising a plurality of radiation fins radially arranged together, a center insertion space surrounded by said radiation fins and coupled to said electrically insulative hollow column of said lamp base unit, and a recessed locating portion located at a top side of said radiation fins around said center insertion space;

a light-emitting module comprising a heat transfer plate mounted at said recessed locating portion of said heat sink, a circuit board supported on said heat transfer plate, and at least one light-emitting device installed in said circuit board;

wherein the accommodation chamber accommodates a power drive module, a through hole located at the topmost edge of said electrically insulative hollow column in communication with said accommodation chamber, and a plurality of longitudinal grooves spaced around the periphery of said electrically insulative hollow column.

2. The LED lamp as claimed in claim 1, wherein said mating connection device of said lamp base unit comprises an externally threaded coupling neck vertically downwardly extended from said electrically insulative base, a metal ring contact surrounding said externally threaded coupling neck, a metal tip contact disposed at a bottom side of said metal ring contact, and an insulative layer isolating said metal tip contact from said metal ring contact.

3. The LED lamp as claimed in claim 1, wherein said lamp base unit further comprises a mounting groove defined within said electrically insulative base around said electrically insulative hollow column and adapted to support said radiation fins, and at least one retaining portion protruded from said electrically insulative base and suspending in said mounting groove; each said radiation fin of said heat sink comprises a first locating notch forced into engagement with said retaining portion of said lamp base unit.

4. The LED lamp as claimed in claim 1, further comprising a lampshade covered over said light-emitting module, said lampshade comprising a light transmission body portion and at least one retaining portion located at an inner bottom side of said light transmission body portion, wherein each said radiation fin comprises a second locating notch respectively forced into engagement with said at least one retaining portion of said lampshade.

5. The LED lamp as claimed in claim 1, wherein said circuit board of said heat sink comprises a center through hole, and a plurality of mounting through holes spaced around the center through hole of said circuit board; said heat transfer plate comprises a center through hole axially aligned with the center through hole of said circuit board, and a plurality of mounting screw holes respectively fastened to said mounting through holes of said circuit board by respective screws.

* * * * *